US005228571A

United States Patent [19]

Anderson

[11] Patent Number: 5,228,571

[45] Date of Patent: Jul. 20, 1993

[54] TUBING AND TUBING FITTING SELECTION APPARATUS

[75] Inventor: Neill E. Anderson, Valencia, Calif.

[73] Assignee: Anderson-Barrows Metal Corporation, Palmdale, Calif.

[21] Appl. No.: 695,614

[22] Filed: May 3, 1991

[51] Int. Cl.[5] ..... B65D 85/04

[52] U.S. Cl. ..... 206/394; 206/391; 206/459.5; 211/13

[58] Field of Search ..... 206/232, 389, 459, 391, 206/394, 459.5; 211/13; 229/126, 155, 131.1

[56] References Cited

U.S. PATENT DOCUMENTS

| | | | |
|---|---|---|---|
| 1,941,746 | 1/1934 | Hill | 206/459 |
| 2,008,429 | 7/1935 | Weatherhead, Jr. | 206/459 |
| 3,127,986 | 4/1964 | Hulka | 206/459 |
| 4,378,884 | 4/1983 | Anderson | 206/459 |
| 4,815,610 | 3/1989 | Borick et al. | 206/459 |

*Primary Examiner*—Jimmy G. Foster

*Attorney, Agent, or Firm*—Poms, Smith, Lande & Rose

[57] ABSTRACT

A tubing and tubing fitting selection apparatus includes the provision of a tubing size identifying code letter on a rectangular box enclosure having a partial cut out exposing portions of the contained coil, there being a different code letter for coils of different dimensional characteristics. A display is provided on the side of the coil box which includes a first array of tubing selection indicia, specifically rows of tubing code letters, the letters of the same rows representing tubing of the same outside diameter size, which is aligned with an array of vertically oriented tubing-fitting indicia which specifically comprise background lining, dots, plain coloring, or speckled indicia. The tubing-fitting indicia are provided as background indicia in association with merchandise selection indicia which are located individual in the bodies of selection matrices on the display which provide for a customer selection of such merchandise selection indicia as a permutation of two different characteristics of the fitting.

11 Claims, 2 Drawing Sheets

Fig. 3.
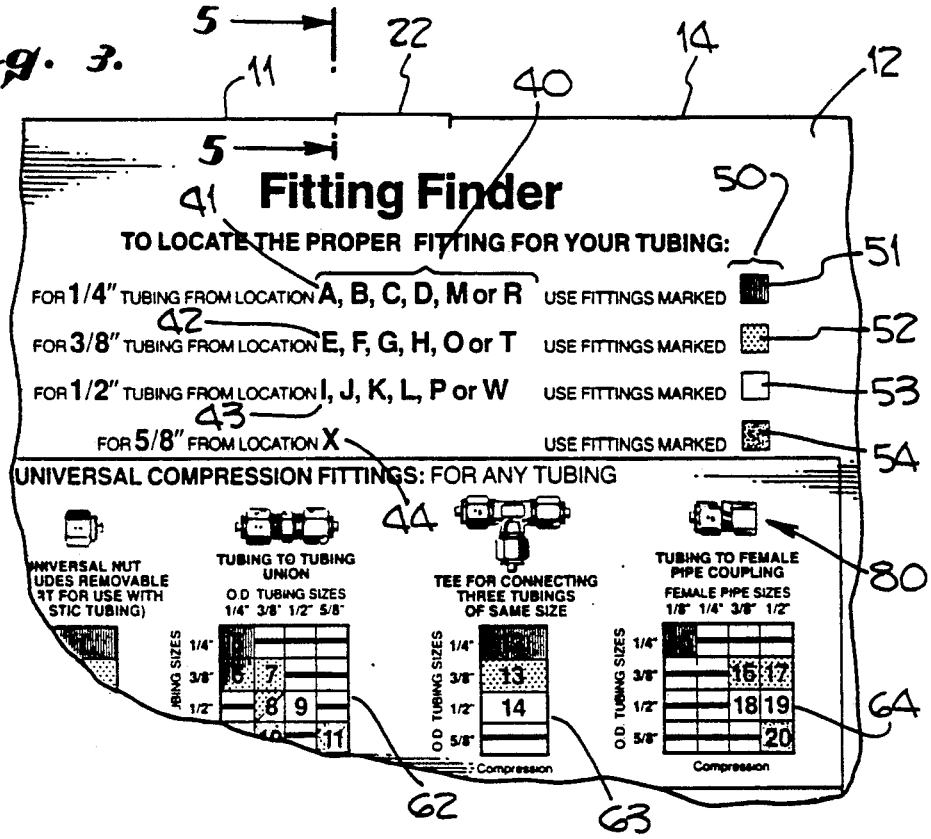
Fig. 4.
Fig. 6.
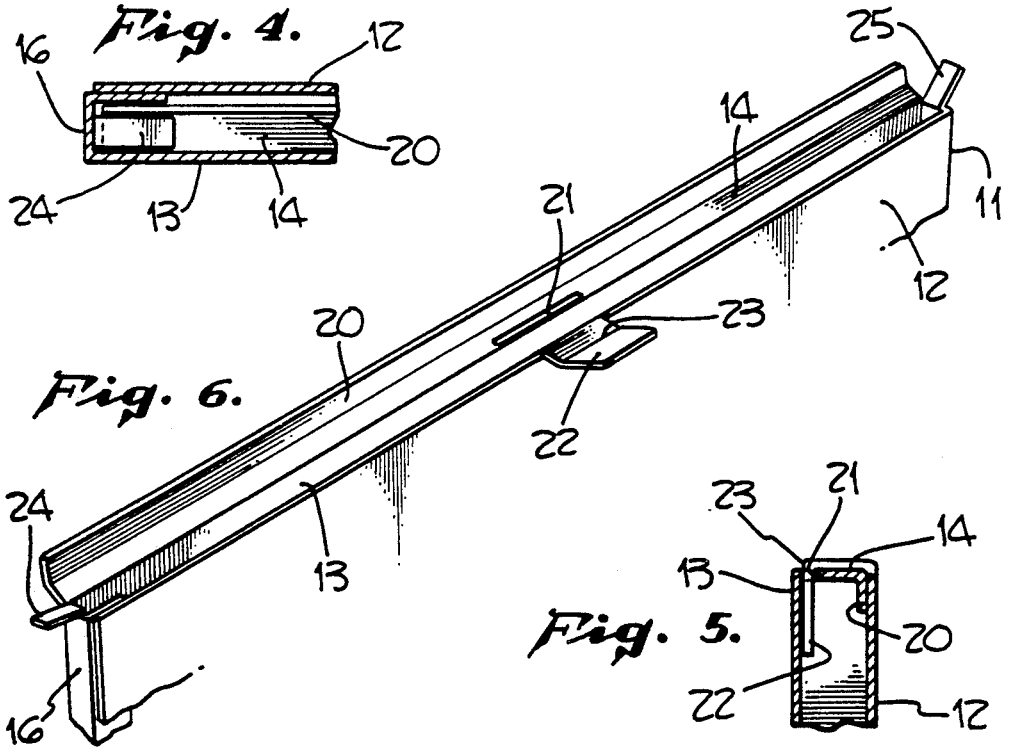
Fig. 5.

TUBING AND TUBING FITTING SELECTION APPARATUS

BACKGROUND OF THE INVENTION

This invention relates in general to apparatus and systems for the display and selection of merchandise and more specifically to a tubing and tubing fitting selection apparatus for selecting compatible pairs of tubing and tubing fittings from a plurality of individually prepackaged tubing and fitting products.

Apparatus and devices for the display and selection of merchandise have been developed heretofore as disclosed in prior U.S. Pat. No. 4,378,884 entitled "APPARATUS AND SYSTEM FOR THE DISPLAY AND SELECTION OF MERCHANDISE". Since the advent of the product of that patent, it has become common to select merchandise, particularly plumbing type fittings from displays having a plurality of prepackaged fitting products hung on display hooks with fittings of like characteristics being suspended together from the same hook or bracket. Such packages, and associated displays, are provided with merchandise identifying indicia in the form of code letters, colors or numbers which facilitate the customers locating the desired fitting after going through a fitting selection indicia locating procedure. In accordance with the apparatus of said patent, such merchandise selection indicia is determined by the customer as a permutation of two separate fitting requirement indicia which may, in the exemplary embodiment of that patent, be associated with matrices having the individual merchandise selection indicia, or merchandise code letters, set forth in the body of such matrices. A matrix for a particular fitting, such as a tubing to tubing union fitting, comprises a vertical axis of tubing outside diameter sizes for the tubing to be connected to one end of the union with the horizontal axis having representations of the different available tubing sizes for the other end of the union. By knowing the dimensions of the tubing for the two ends of the union, and having selected the matrix corresponding to such union, the merchandise selection number is determined from the matrix as a permutation of such two requirement sizes for the union. It is suggested that those unfamiliar with the display of said patent, or the disclosure thereof, make reference to said patent disclosure for a more complete understanding thereof.

It has come to my attention that it would be desirable to facilitate the selection of the particular merchandise selection indicia or code for a given fitting where a customer has selected a particular size of tubing without the need for the customer examining the precise requirement indicia provided on the display of the prior U.S. Pat. No. 4,378,884. It has also come to my attention that it would be desirable to provide a more convenient way for the consumer to select and obtain lengths of copper tubing and compatible fittings, particularly where the consumer is unfamiliar with tubing and fitting terminology and sizing requirements and is seeking to accomplish a so called "do it yourself" project.

SUMMARY OF THE INVENTION

It is therefore the primary object of the present invention to disclose and provide a tubing and tubing fitting selection apparatus to facilitate an uninformed consumer's selection of tubing and a compatible tubing fitting in an easy and forth right manner. It is also an object of the present invention to provide a packaging vehicle for the tubing in a form which would vehicle for the tubing in a form which would be attractive, facile and appealing to the consumer who is seeking to obtain a length of copper tubing to accomplish some desired plumbing task.

It is a further object of the present invention to disclose and provide an apparatus and selection method which facilitates the selection of a mating tubing fitting once the customer has selected and has in hand a length of copper tubing for his particular project.

Generally stated, the present invention in a tubing and tubing fitting selection apparatus for selecting compatible pairs of tubing and fittings comprises the provision of a plurality of individually prepackaged tubing coils and tubing fittings of differing characteristics in separate containers thereof. The tubing lengths are provided in coil form within tubing containing boxes having the feature of being stackable vertically on end in a horizontal array thereof. Preferably each box has a cut out of a front portion thereof to exhibit a portion of the coil contained therein to allow customer visual and digital contact. As is particularly contemplated within the present invention, a tubing identifying indicia is provided on the outside of the box, in the exemplary embodiment the same comprising a capital letter indicia or code. A plurality of individual tubing-fitting indicia, which comprise background patterns in the exemplary embodiment, are provided in an array thereof aligned with a first array of tubing identifying indicia. When a customer has selected a particular coil box having a tubing identifying indicia in the form of a code letter, or the like thereon, he compares the location of such code letter in the tubing identifying indicia array with an aligned corresponding tubing-fitting indicia, a background pattern indicia in the exemplary embodiment, to determine a particular corresponding tubing-fitting indicia.

The fitting selection indicia is provided on matrices on the exemplary embodiment of the present invention in the format of the prior U.S. Pat. No. 4,378,884 with the addition of the tubing-fitting indicia as a background thereto to facilitate the customer's selection of the desired fitting selection indicia. The customer having chosen a particular coil of tubing is thereby relieved of the need to compare the tubing size as a fitting requirement indicia on the matrices of the associated display, which is provided preferably on the side of the coil box, in seeking the desired fitting.

In accordance with the invention, once the customer has selected the particular coil of tubing of his choice, he is led by the apparatus of the present invention to a tubing-fitting indicia, specifically a background pattern, which is provided in association with the merchandise selection indicia or code numbers of the exemplary embodiment on the matrices so that the desired fitting is simply located by selecting the appropriate fitting matrix and the fitting selection indicia which overlies the predetermined background pattern indicia.

It is believed that a more complete understanding of the tubing and tubing fitting selection apparatus of the present invention will be afforded to those skilled in the art from a consideration of the following detailed description of a preferred exemplary embodiment thereof. Reference will be made to the appended sheets of the drawings which will be first described briefly.

BRIEF DESCRIPTION OF THE DRAWINGS

FIG. 3 is an enlarged view of a portion of the apparatus of FIG. 1.

FIG. 4 is a section view through the apparatus of FIG. 1 taken therein along the plane 4—4.

FIG. 5 is a section view of the apparatus of FIG. 3 taken therein along the plane 5—5.

FIG. 6 is an end view of an upper end closure wall of the container of the apparatus of FIG. 1 showing the end closure flap in open position.

DETAILED DESCRIPTION OF THE PREFERRED EXEMPLARY EMBODIMENT

A preferred exemplary embodiment of the tubing and tubing fitting selection apparatus in accordance with the present invention is illustrated in FIGS. 1 through 6 of the accompanying drawings. As is particularly contemplated within the present invention, the tubing and tubing fitting selection apparatus is intended for use with copper tubing coils, as the tubing coil indicated generally at 10 at FIGS. 1 and 2 which may be of given diameter and length for conventional "do it yourself" type jobs. Exemplary thereof is the coil, indicated generally at 10, which is represented as being a tubing coil of ten feet in length and one-quarter inch in outside diameter.

Figure 2:
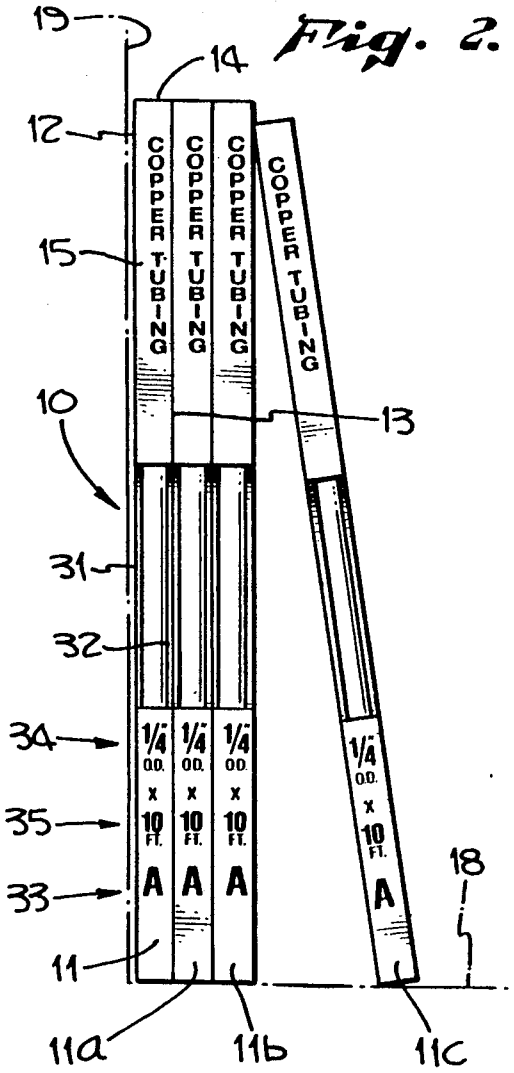
FIG. 2 is a front elevational view of a horizontal array of tubing coil containing boxes standing on end in generally adjacent relationship ready for customer selection thereof.

As is also particularly contemplated within the present invention, the tubing coils, in accordance with the present selection apparatus and method, are provided individually within containers, such as the box 11, which are adapted to receive the coil there within. The exemplary box 11 is provided with flat panel side walls 12 and 13, a top wall 14, front wall 15, rear wall 16 and bottom wall 17. The side panel walls 12 and 13 are fairly large rectangular configuration to overlie the lateral extent of the tubing coil contained therein while the end walls 14–17 are of relatively narrow extent which is sufficient to accommodate the relatively narrow width tubing coils as illustrated. A plurality of such boxes may be stacked in a horizontal array as seen in FIG. 2 with the boxes 11, 11*a*, 11*b* and 11*c* resting upon a support surface 18 adjacent a side wall 19 as on typical commercial display shelving.

As seen in FIGS. 4, 5 and 6, the coil box 11 is provided in such a manner that the top wall 14 may be opened and closed to facilitate insertion and removal of the tubing coil relative thereto. Upper end wall 14 is provided with a closure flap 20, the flap 20 being integral of end wall 14 which in turn is integral of the box rear wall 13. A tab receiving slit 21 is provided in the exemplary embodiment through a portion of the top end wall 14 adjacent its connection to side wall 13. Locking tab 22 is provided integral of the other side wall 12 and is foldable along fold line 23 to fold over adjacent portions of the closure flap 20 and end wall 14, when the latter are in closed position, to enter the slit 21 and hold the box in closed condition as best seen in FIG. 5. End tabs 24 and 25 are also provided to facilitate the closure of this openable end of the box and thus the retention of the tubing coil therein prior to its intended use.

Figure 1:
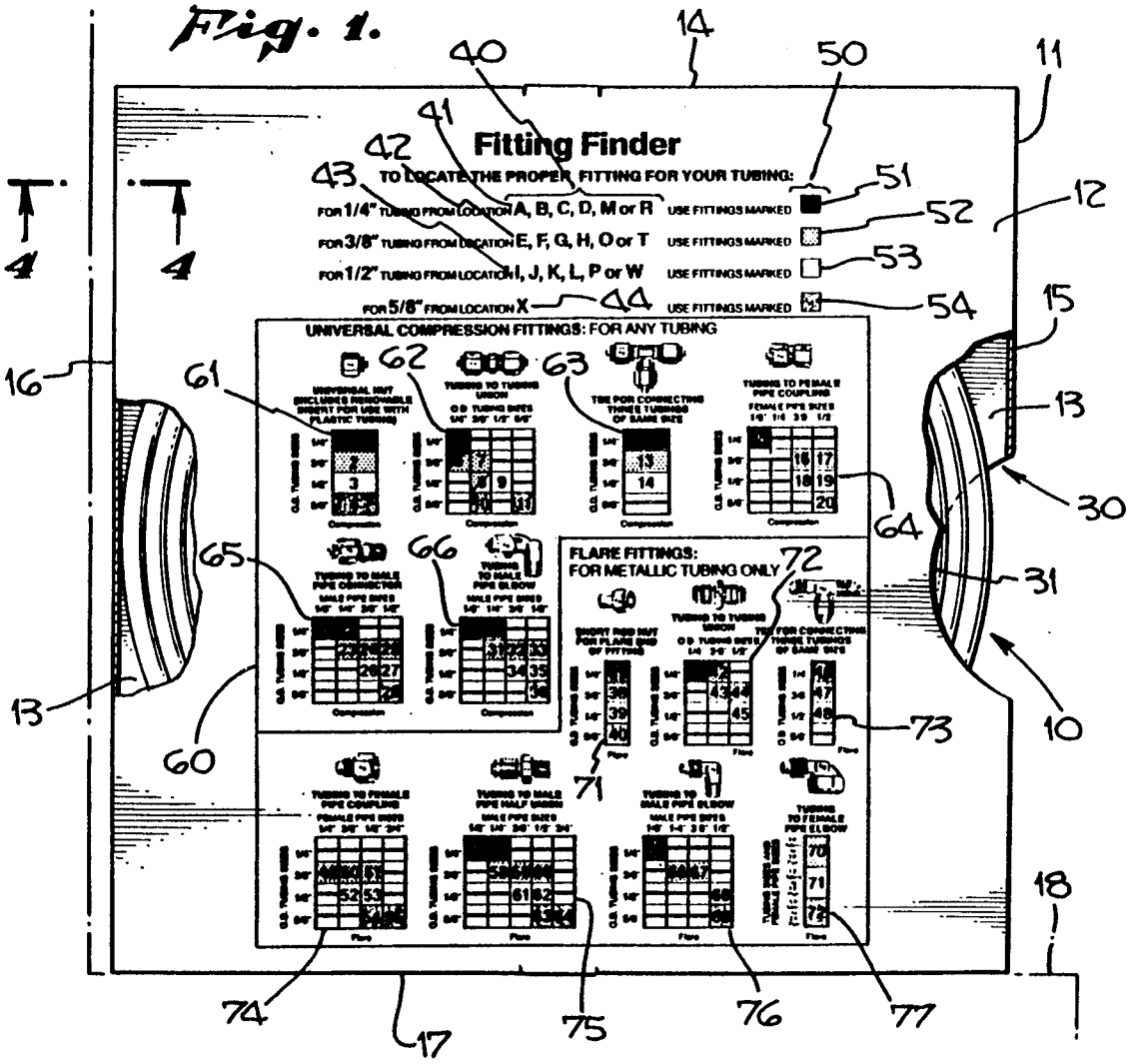
FIG. 1 is a side elevational view of an exemplary embodiment of tubing and tubing fitting selection apparatus in accordance with the present invention for selecting compatible pairs of tubing and fittings from a plurality of individually prepackaged tubing coils and fittings of differing characteristics, the container thereof being shown partially in section to reveal portions of the tubing coil contained therein.

A coil exposing cut out, indicated generally at 30 in FIG. 1, is provided to allow customer inspection of the tubing coil contained within the container box 11. As seen in the exemplary embodiment of FIGS. 1 and 2, the box 11 has a generally arcuate cut out 31 in side wall 12 and arcuate cut out 32 in side wall 13, as well as a cut out of adjacent portions of front wall 15 to expose an arcuate portion of the outer extremities of the tubing coil so that the same is accessible to a customer for visual and/or digital contact.

Tubing identifying indicia are provided on the box indicative of at least one or more dimensional characteristics of the coil of tubing contained therein in accordance with the present invention. As seen in the exemplary embodiment, a tubing identifying indicia or code is provided by a printed indicia, indicated generally at 33, which in the exemplary embodiment comprises a capital letter of the alphabet. As is also provided on the identifying indicia on the exemplary embodiment, the outside diameter size of the exemplary coil of tubing, one-quarter inch, is indicated by the printing indicia indicated generally at 34 while the tubing length, ten feet in the exemplary embodiment, is indicated by the printed indicia indicated generally at 35. The indicia 34 and 35 are intended to tell the customer the dimension of the tubing coil contained therein while the indicia, indicated generally 33, is intended as a code to facilitate the consumer selecting a compatible tubing fitting as described hereinafter. It is contemplated within the present invention that tubing coils having differing size and length characteristics will be identified by different letters of the alphabet and that such tubing identifying indicia or code is presented in an array thereof on a display associated with the tubing and tubing fitting selection apparatus of the present invention.

Referring now to FIG. 1, it is noted that printed indicia is provided on the side panel wall 12 in accordance with the present invention. However, it should be noted that the words "fitting finder" comprise a registered trademark of Anderson-Barrows Metals Corporation, the assignee of the within invention. In addition, consumer directing indicia may be provided upon the panel in order to direct the consumer to follow a selection method as subsequently described. In the exemplary embodiment, such printing indicia comprises the words "to locate the proper fitting for your tubing:". Below these consumer directing indicia, the apparatus of the present invention includes the provision of an array of tubing identifying indicia which is correlated to an associated array of tubing-fitting indicia. As best seen in FIG. 1, the array of tubing identifying indicia comprises the vertical column 0 of four horizontal lines 41, 42, 43 and 44 of letter codes identifying corresponding individual ones of a plurality of coil boxes containing tubing coils of differing sizes and lengths. By way of example, line 41 contains the letters A, B, C, D, M or R, each of which relates to a tubing coil box having a quarter inch tubing therein but of differing lengths. By way of example, indicia code A indicates a tubing coil of one-quarter inch and ten foot length. Letters B, C, and D may indicate coils of quarter inch outside diameter which have lengths of fifteen, twenty and twenty-five feet respectively. Letters M or R may be employed for much longer or shorter lengths of tubing as desired. Similarly, the letters employed for boxes having three-eighth inch tubing coils therein are set forth in row 42 including the letters E, F, G, H, Q or T. Such letters may indicate coil lengths of ten feet, fifteen, twenty and twenty-five for the letters E through H and much longer or shorter lengths for the letters O and T as desired. Row 42 includes the letters E, F, G, H, O or T in the exemplary for three-eights inch tubing coils, the letters E through H, by way of example, indicating tubing lengths of ten, fifteen, twenty and twenty-five foot lengths. Letters Q or T may indicate longer or shorter lengths as desired. Row 43 includes the code letters J, K, L, P or W for one-half inch tubing coils, the letters I, J, K, and L corresponding to coil lengths of ten, fifteen, twenty and twenty-five feet by way of example. Letters P and W may be employed for coil lengths which are much longer or shorter as desired. Row 44 in the exemplary embodiment has a single code letter X for a five-eights inch outside diameter tubing coil which may have a given length such as ten feet by way of example. As can be seen from the foregoing, the size and length of the tubing coil within a given coil box 11 is combined into an identifying code letter in the exemplary embodiment to provide a specific identifying code which may be applied, as at 33 on box 11 in the exemplary embodiment, to the coil container for observation by the customer when he selects the tubing coil of his choice.

An array of tubing-fitting indicia are provided on the display surface provided by box side wall 12 in the exemplary embodiment as seen at 50 in FIGS. 1 and 3. Such tubing-fitting indicia array, indicated generally at 50, includes a vertical column of individual boxes having individual patterns associated therewith as seen by individual tubing-fitting indicia 51, 52, 53 and 54. Tubing-fitting indicia 51 comprises a background of vertical lining associated with the row 41 of tubing indicia indicating a tubing outside diameter of one-quarter inch. Thus while the individual coil boxes 11 selected by a customer may have differing lengths, as foot lengths. Letters 0 or T may indicate longer or determined by the letter codes A–D, M or R, they each will have a one-quarter inch tubing ID which is translated by a comparison of the tubing indicia array 40 line 41 with the horizontally aligned box 51 of the tubing-fitting indicia array 50. Tubing-fitting indicia 52 comprises a dotted background which is associated with three-eighth inch coils of various lengths correlated to the letters E–H, O or T in the exemplary embodiment. As seen in FIG. 3, the tubing-fitting indicia 53 comprises a plain background while the tubing-fitting indicia 54 comprises a speckled background. As is particularly contemplated within the present invention, the selection of a compatible fitting from the fitting selection display, as hereinafter described, is facilitated by the use of the tubing-fitting indicia, specifically the individual background indicia of boxes 51, 52, 53, and 54 which are selected by the customer comparing the tubing coil code letter of his selected coil box 11 with that letter's position on the tubing indicia array 40 and then determining the corresponding tubing-fitting indicia of the adjacent array 50.

Referring once again to FIG. 1, once the customer has determined the tubing-fitting indicia of the tubing fitting-indicia array 50 as discussed above his selection of the appropriate fitting from the fitting display, indicated generally 60 is greatly facilitated. The fitting display 60 comprises a plurality of matrices 61 through 66 for universal compression fittings. Matrices 71 through 77 and for flare fittings as illustrated in FIG. 1 and as disclosed in the prior Anderson U.S. Pat. No. 4,378,884 entitled "APPARATUS AND SYSTEM FOR THE DISPLAY AND SELECTION OF MERCHANDISE", individual sections of the each of such matrices being provided with the background indicia of tubing-fitting indicia 51 through 54 as will now be described. Initially, it is noted that the disclosure of the prior Anderson U.S. Pat. No. 4,378,884 is incorporated herein by this reference as though fully set forth herein. As more fully set forth in such patent, individual fittings may be selected by reference to individual matrices which comprise bodies of individual squares having merchandise selection indicia thereon in the form of numeric codes. As seen in FIG. 1, the numbers 1 through 72 on the individual squares of the body portions of each of the matrices 61 through 77 comprise merchandise selection indicia in letter form which correspond to a like letter code provided on the package for such fitting or on the display associated with the fitting. Such merchandise selection indicia or letter code is selected in the Anderson patent by the combining of the tubing dimension requirement indicia, as by example a one-quarter inch outside diameter, with a second fitting requirement indicia, such as the pictorial representation of the fitting or the printed identification of the fitting, to then select the merchandise selection indicia or code number as a permutation thereof. Referring to the enlarged detail view of the FIG. 3, by way of example, the matrix 64 has the fittings tubing requirement indicia listed along the left hand side vertical axis as one-quarter inch, three-eighth inch, one-half inch and five-eight inch requirements. Across the top of matrix 64 is additional requirement indicia for the fitting which may include the size of the pipe which the fitting is to be connected and/or the description or pictorial representation of the fitting itself. If a fitting is to be connected between one-quarter inch tubing and one-eighth inch pipe and is to be of a tubing to female pipe coupling type fitting, the matrix 63 allows the customer to select merchandise selection indicia 15 as a permutation thereof. An associated merchandise display having such fittings associated with the number 15 on the display, or on the package for the fittings may then be selected by the customer who knows by the code number which prepackaged fitting product to select. In accordance with the procedure of fitting selection of the prior Anderson patent, the customer may determine the tubing size by measuring an exemplary fitting or tubing with a tubing size chart associated with the display apparatus of such patent. In accordance with the present invention, it is contemplated that a customer may simply select a length of copper tubing in coil form by selecting the appropriate prepackaged coil, as coil 10 in FIGS. 1 and 2, determine the tubing indicia or code letter "A" provided on the container thereof, and compare the location of such code letter on tubing indicia array 40 with its horizontal alignment with a tubing-fitting indicia of array 50 to determine a background indicia of one of the tubing indicia 51 through 54. In the exemplary embodiment, the tubing indicia code letter "A" determines the selection of a vertical line background indicia 51 as seen in FIG. 3. Without the need to go to sizing charts or other sources of information, the customer may simply look at the pictorial representation of the tubing to female pipe coupling, as indicated generally at 80 in FIG. 3, and then go to the appropriately colored background corresponding to indicia 51 which, in matrix 64, provides for the selection of merchandise selection indicia or number code 15.

The tubing-fitting indicia of the array 50 provides the customer with an easily perceived visual indicia on the matrices 61 through 77 to facilitate the location of the appropriate tubing size for the fitting being selected. It is almost automatically presented to the customer once he has selected the desired tubing coil from a plurality of the same and observes the tubing indicia code letter on the box. However, when the particular fitting is adapted to connect to pipe of differing sizes, the customer will still wish to select from the available choices which are greatly reduced by the background indicia of the tubing-fitting indicia 51 through 54 as seen on the display of the exemplary embodiment in FIGS. 1 and 3. By way of example, a three-eighth inch OD tubing coil as might be determined by the tubing code letter E, F, G, H, O or T, might be intended to be used by the customer in association with a tubing to tubing union which would direct him to matrix 62. In matrix 62, if the customer is aware that the other tubing of the fitting is to be of the same size, he will select the merchandise selection code 7. However if he wishes to connect a tubing to tubing union from the selected coil tubing three-eight inch diameter on one end of the union to a one-quarter inch tubing on the other end of the tubing, then he would select the fitting selection indicia code number 6 as is apparent from an inspection of matrix 62 in FIG. 4.

As is apparent from the foregoing, the boxes which have a background other than the one compatible with the tubing selection indicia or code letter are quickly visually eliminated by the customer from his selection process and thus the selection of the particular desired fitting which is compatible with the coil tubing already selected is greatly facilitate by the tubing and tubing fitting selection apparatus of the present invention. Having tush described a preferred exemplary embodiment of a tubing and tubing fitting selection apparatus in accordance with the present invention, it should not be apparent to those skilled in the art that the various objectives and advantages stated hereinbefore have been attained by the within invention which is defined by the following claims.

I claim:

1. A tubing and tubing fitting selection apparatus for selecting compatible pairs of tubing and fitting from a plurality of individually prepackaged tubing coils and fittings of differing characteristics, said prepackaged fittings each having its own identifying indicia associated therewith which corresponds to a fitting selection indicia which is a permutation of first and second fitting requirement indicia on a fitting selection display, said apparatus comprising:

a plurality of containers for packaging coils of tubing of differing dimensional characteristics;

tubing identifying indicia on each of said containers indicative of at least one dimensional characteristic of said coil of tubing; and a plurality of individual tubing-fitting indicia on said display and individually associated with individual ones of said fitting selection indicia on said display which indicate fittings compatible with the coil of tubing identified by said tubing identifying indicia.

2. The tubing and tubing fitting selection apparatus of claim 1 wherein said plurality of containers for packaging said coils of tubing comprising:

one or more rectangular boxes each having planar side walls connected by front, rear, top and bottom end walls of an extent sufficient to receive a coil of tubing therewithin.

3. The tubing and tubing fitting selection apparatus of claim 2 wherein said containers further comprises:

a tubing-apparatus indicia selection placard integral with a side of each of said boxes and displaying an array of individual fitting selection matrices each containing an array of tubing identifying indicia adjacent an array of tubing-fitting indicia with individual ones of said tubing-fitting indicia aligned with corresponding individual ones of said tubing identifying indicia.

4. The tubing and tubing fitting selection apparatus of claim 2 wherein said containers further comprising the provisions of:

a fitting selection placard integral with a side of each of said containers and displaying an array of individual fitting selection matrices.

5. The tubing and tubing fitting selection apparatus of claim 4 wherein:

said fitting selection indicia comprise numeric codes on said fitting selection display and said tubing-fitting indicia associated therewith comprise background patterns relative said numeric codes.

6. A tubing and tubing fitting selection apparatus for selecting compatible pairs of tubing and fittings from a plurality of individually prepackages tubing coils and fittings of differing characteristics, said prepackaged fittings each having a fitting identifying indicia associated therewith which corresponds to a fitting selection indicia which is a permutation of first and second fitting requirement indicia on a fitting selection display, said apparatus comprising:

a container for packaging a coil of tubing of given dimensional characteristics;

tubing identifying indicia on said container indicative of at least one dimensional characteristic of said coil of tubing;

a plurality of individual tubing-fitting indicia on said display and individually associated with individual ones of said fitting selection indicia on said display which indicate fittings compatible with the coil of tubing identified by said tubing identifying indicia;

a rectangular box having planar side walls connected in front, rear, top and bottom end walls of an extent sufficient to receive a coil of tubing therewithin; and a coil exposing cut out of portions of box front and side walls whereby an arcuate portion of outer extremities of said coil of tubing is accessible exteriorly of said box.

7. The tubing and tubing fitting selection apparatus of claim 6 wherein said container for packaging said coil of tubing further comprises:

one of said top, bottom and rear walls being provided as a portion of a container closure including integral wall and closure flap positions with said wall portion being integral with an adjacent side wall of said container;

a tab receiving slit in said one of said top, bottom and rear walls adjacent said adjacent side wall; and a locking tab integral with the other of said side walls of said container and extending into said slit to hold said container closure in a closed relation relative the coil of tubing container therein.

8. A tubing and fitting selection apparatus comprising:

a plurality of tubing coil boxes standing one end and adjacent one another in an array thereof, each of said boxes containing a coil of tubing;

a first indicia on an outwardly facing front side of each of said boxes indicating a size characteristic of the tubing contained therein; and a tubing associated product selection placard provided as a part of one or more of said boxes and displaying an array of individual selection matrices for each of a plurality of products to be associated with said tubing, at least some of said matrices having an additional product selection indicia correlated to said first indicia on said boxes.

9. A tubing and tubing fitting display and selection system comprising:

a plurality of tubing coil boxes standing one end and adjacent one another in an array thereof, each of said boxes containing a coil of tubing and having a tubing requirement indicia on a front edge thereof facing outwardly of said array; and a tubing fitting selection placard integral with a side of said box and displaying an array of individual fitting selection matrices for each of a plurality of fitting products to be associated with said tubing, said matrices each having a body containing merchandise selection indicia selectable as a permutation of merchandise requirement indicia on two axis of such matrix, and wherein at least some of said matrices are further provided with additional selection indicia in the body thereof which are correlated to said tubing requirement indicia.

10. A product selection apparatus comprising:

a plurality of coil boxes standing on end and adjacent each other in an array, each box containing a coil of tubing and a first indicia on the outwardly facing front edge thereof indicating a size characteristic of the coil containing therein; and a product selection placard displaying an array of individual selection matrices for each of a plurality of products to be associated with said tubing, at least some of said matrices having an identifying indicia thereof correlated to the first indicia.

11. The product selection apparatus of claim 10 wherein:

said product selection placard is provided as a part of one or more of said boxes.

* * * * *